United States Patent [19]

Atkins et al.

[11] Patent Number: 4,475,516

[45] Date of Patent: Oct. 9, 1984

[54] FUEL RAIL ASSEMBLY AND CLIP

[75] Inventors: Terrance J. Atkins, Rochester; Martin J. Field, Churchville; Andrew J. Makusij, Fairport, all of N.Y.

[73] Assignee: General Motors Corporation, Detroit, Mich.

[21] Appl. No.: 490,483

[22] Filed: May 2, 1983

[51] Int. Cl.[3] ..... F02M 55/00

[52] U.S. Cl. ..... 123/470; 239/600; 285/305; 403/326

[58] Field of Search ..... 123/468, 469, 470, 471; 239/600, 551; 292/353; 24/542, 543, 531; 285/305; 403/326, 321

[56] References Cited

U.S. PATENT DOCUMENTS

| | | | |
|---|---|---|---|
| 3,298,409 | 1/1967 | Elson | 403/326 |
| 4,246,877 | 1/1981 | Kennedy | 123/470 |
| 4,307,693 | 12/1981 | Glockler et al. | 123/471 |
| 4,352,586 | 10/1982 | Hayden | 285/305 |

FOREIGN PATENT DOCUMENTS

| | | | |
|---|---|---|---|
| 3014066 | 10/1981 | Fed. Rep. of Germany | 123/470 |
| 678194 | 8/1979 | U.S.S.R. | 123/470 |

*Primary Examiner*—Magdalen Y. C. Moy
*Attorney, Agent, or Firm*—C. K. Veenstra

[57] ABSTRACT

A clip received in a groove about an engine fuel injector and rotated into grooves in a fuel rail body secures the injector in its socket in the fuel rail body.

4 Claims, 4 Drawing Figures

FUEL RAIL ASSEMBLY AND CLIP

TECHNICAL FIELD

This invention relates to assembly of a fuel rail for delivering fuel to an engine.

BACKGROUND

Some fuel injection systems for automotive spark ignition engines have a plurality of fuel injectors each of which delivers fuel to the inlet port of an associated engine combustion chamber. In some such systems, the fuel injectors are mounted in sockets of a fuel rail body which has a passage to supply fuel to the injectors; such a fuel rail assembly simplifies installation of the fuel injectors and the fuel supply passage on the engine.

SUMMARY OF THE INVENTION

This invention provides an improved construction for retaining an engine fuel injector in a socket of a fuel rail body.

In a fuel rail assembly according to this invention, a fuel injector is retained in a socket of a fuel rail body by an improved clip construction; the clip is first engaged in a groove about the injector; and then after the injector is inserted in the socket of the fuel rail body, the clip is rotated about the injector to engage in grooves in the fuel rail body. With this construction, the injector is securely retained in its socket by an unobtrusive clip, and yet the injector may be readily removed from the fuel rail body if required for service.

The details of the preferred embodiment as well as other features and advantages of this invention are set forth in the remainder of the specification and are shown in the accompanying drawing.

THE PREFERRED EMBODIMENT

Figure 1:
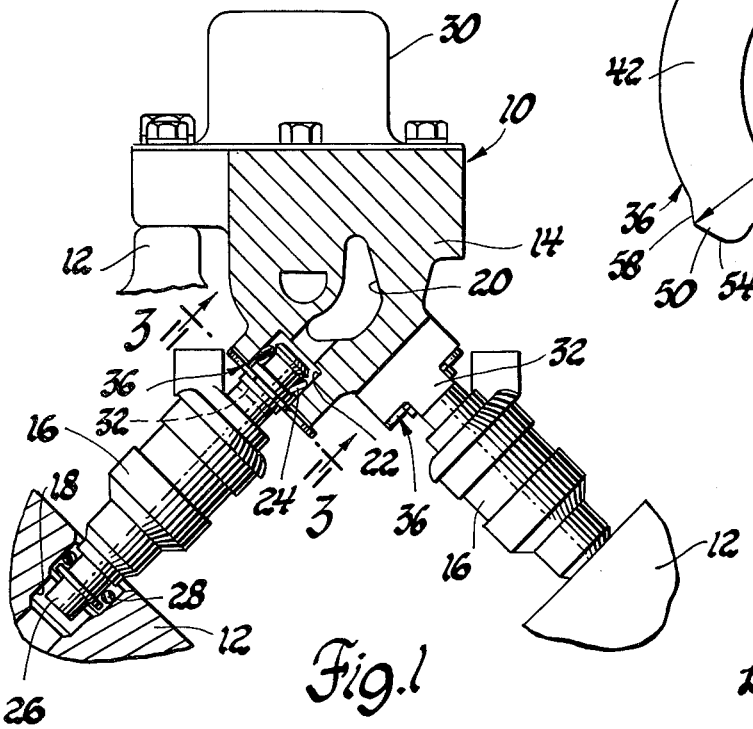
FIG. 1 is a transverse sectional view of a fuel rail assembly having injectors secured according to this invention.

Referring first to FIG. 1, a fuel rail 10 is secured on an inlet manifold 12 of an automotive spark ignition engine. Fuel rail 10 includes a body 14 which supports a plurality of injectors 16 each of which delivers fuel through an associated opening 18 in manifold 12 to an inlet port for one of the engine combustion chambers.

Fuel rail body 14 is extruded to form a fuel supply passage 20, and injector sockets 22 are machined transversely into body 14 to intersect the lower portion of fuel supply passage 20. Each socket 22 receives an injector 16, with an O-ring 24 sealing the injector-socket interconnection. The tip 26 of each injector 16 is received in the corresponding opening 18 in manifold 12 and has an O-ring 28 to seal the injector-manifold interconnection.

Fuel injectors 16 preferably are conventional electromagnetic fuel injectors energized by a conventional electronic control unit. Each injector 16 receives fuel from its socket 22 and, when energized, delivers a timed pulse of fuel for mixture with the air which flows to the combustion chambers through manifold 12.

Many details of fuel rail body 14 and its associated pressure regulator 30 are set forth in copending application Ser. No. 410,641 filed Aug. 23, 1982 in the names of T. J. Atkins, M. J. Field and D. J. Lamirande and need not be described further here. It should be noted, however, that in the present embodiment a transversely projecting rib 32 extends axially along the lower portion of each side of fuel rail body 14, and the diameter D1 of injector sockets 22 exceeds the width W of rib 32. At each socket 22, rib 32 has a pair of arcuate grooves 34 concentric with and opening into opposite sides of socket 22.

Figure 2:
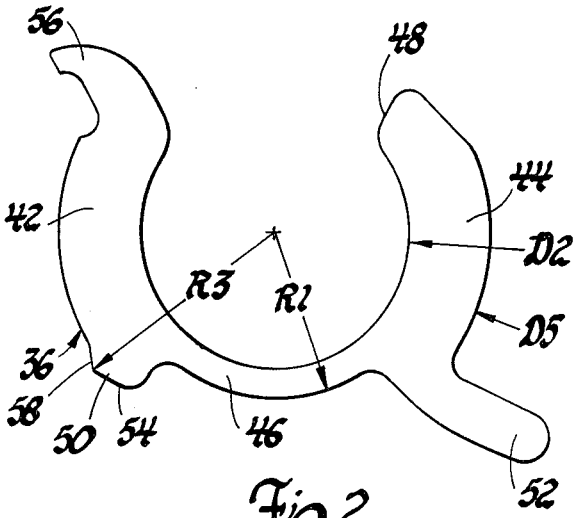
FIG. 2 is a view of the clip employed to secure each injector to the fuel rail body.
Figure 3:
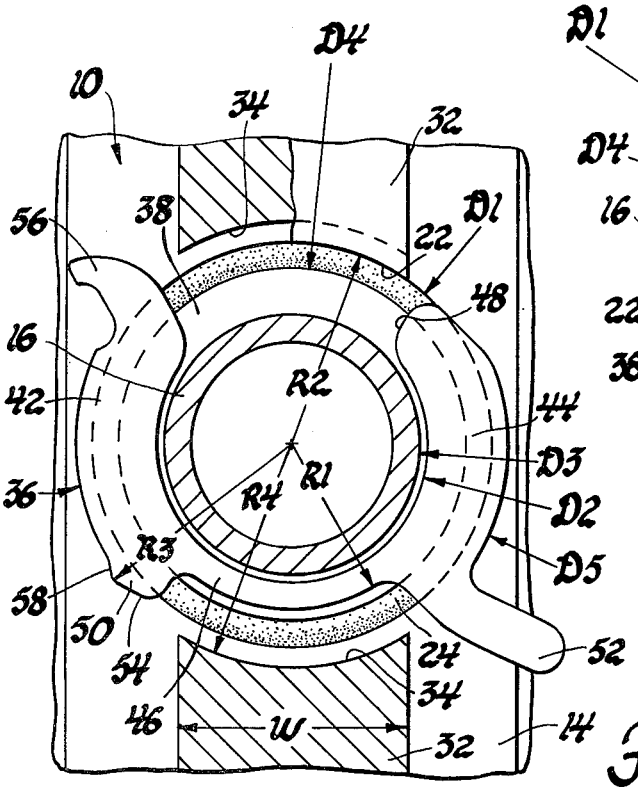
FIG. 3 is a sectional view, indicated by the line 3—3 of FIG. 1, showing the clip engaged about the injector prior to engaging the clip in the fuel rail body.
Figure 4:
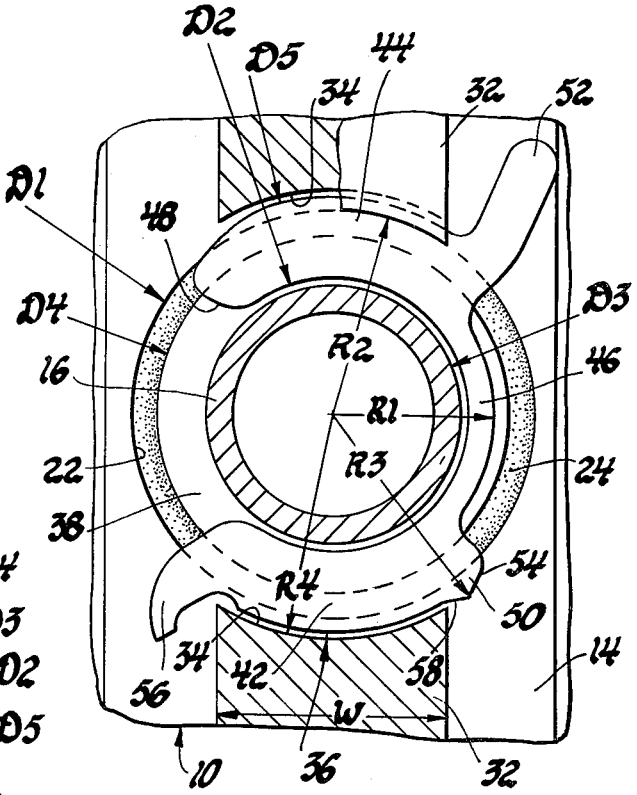
FIG. 4 is a view similar to FIG. 3 showing the clip retaining the injector in its socket.

Each injector 16 is secured to fuel rail body 14 by a clip 36 which engages in a peripheral groove 38 about injector 16 and in arcuate grooves 34 in fuel rail body 14. As shown in FIGS. 2–4, clip 36 has an arcuate configuration with an inside diameter D2 exceeding the diameter D3 of injector 16 measured in peripheral groove 38.

The arcuate configuration of clip 36 defines a pair of leg sections 42 and 44 joined on one side by an intermediate section 46 and separated on the opposite side by a gap 48. Gap 48 is smaller than the diameter D3 of peripheral groove 38, and the inside diameter D2 of clip 36 is smaller than the diameter D4 of injector 16 measured adjacent peripheral groove 38. Leg sections 42 and 44 separate slightly as clip 36 is engaged in peripheral groove 38, and clip 36 is thereafter retained in peripheral groove 38.

The outside radius R1 of intermediate section 46 of clip 36 is less than the radius R2 of socket 22, and both the chord of intermediate section 46 and gap 48 approximate the width W of rib 32. Thus alignment of intermediate section 46 and gap 48 with rib 32, as shown in FIG. 3, allows injector 16 to be inserted in socket 22 with clip 36 engaged thereabout.

Leg sections 42 and 44 have an external diameter D5 exceeding the diameter D1 of socket 22. At the intersection of leg section 42 and intermediate section 46, clip 36 includes a locking tab 50 which projects beyond leg section 42 to a radius R3 greater than the radius R4 of arcuate grooves 34. At the intersection of leg section 44 and intermediate section 46, clip 36 includes an operating tab 52 which also projects beyond leg section 44 to a radius greater than the radius R4 of arcuate grooves 34. With injector 16 inserted in socket 22, operating tab 52 is employed to rotate clip 36 in grooves 34 and 38. As the edge 54 of locking tab 50 engages rib 32, clip 36 compresses about injector 16 to permit locking tab 50 to pass through arcuate groove 34. As locking tab 50 exits arcuate groove 34, clip 36 expands to engage leg sections 42 and 44 in arcuate grooves 34 as shown in FIG. 4.

As shown in FIG. 4, operating tab 52 will engage rib 32 to inhibit further rotation of clip 36, and locking tab 50 will engage rib 32 to inhibit counter rotation of clip 36. Clip 36 is thus retained in arcuate grooves 34 of fuel rail body 14 as well as peripheral groove 38 of injector 16 and retains injector 16 in socket 22.

Clip 36 also includes a second operating tab 56 at the free end of leg section 42 which may be employed to counter rotate clip 36. During counter rotation, edge 58 of locking tab 50 will engage rib 32, causing clip 36 to compress about injector 16 sufficiently to permit locking tab 50 to pass through arcuate groove 34. After locking tab 50 is counter rotated through arcuate groove 34, intermediate section 46 and gap 48 are again aligned with rib 32 to allow injector 16 to be withdrawn from socket 22.

It will be noted that locating operating tab 52 at the intersection of leg section 44 and intermediate section 46 causes clip 36 to compress when rotational force is applied to operating tab 52 and the edge 54 of locking tab 50 engages rib 32. Similarly, locating operating tab 56 at the free end of leg section 42 causes clip 36 to compress when counter rotational force is applied to operating tab 56 and the edge 58 of locking tab 50 engages rib 32. In the absence of rotational force on tab 52 or counter rotational force on tab 56, together with engagement of tab 50 against rib 32, clip 36 expands to engage leg sections 42 and 44 in grooves 34. Clip 36 accordingly retains injector 16 securely in socket 22.

As may be noted from FIG. 4, operating tabs 52 and 56 nestle beside rib 32 after rotation of clip 36 to secure injector 16 in socket 22. Clip 36 therefore has an unobstrusive construction which will not interfere with service of other engine components. Yet in the event injector 16 requires service, the hook-shaped configuration of operating tab 56 makes it readily accessible for counter rotation of clip 36 so injector 16 may be removed.

The embodiments of the invention in which an exclusive property of privilege is claimed are defined as follows:

1. A fuel rail assembly comprising a fuel rail body having a transversely projecting rib and an injector socket opening transversely through said rib, the diameter of said socket exceeding the width of said rib, said rib having arcuate grooves concentric with and opening into opposite sides of said socket, an injector inserted in said socket, said injector having a peripheral groove, and a clip engaged in said grooves, said clip having an arcuate configuration with an inside diameter exceeding the diameter of said peripherl groove and less than the diameter of said injector adjacent said peripheral groove, said arcuate configuration defining a pair of leg sections with an external diameter exceeding the diameter of said socket, said arcuate configuration further defining an intermediate section connecting said leg sections and having an external radius less than the radius of said socket, said clip further including a locking tab at the intersection of one of said leg sections and said intermediate section and an operating tab at the intersection of the other of said leg sections and said intermediate section, said tabs projecting to a radius exceeding the radius of said arcuate grooves, whereby said clip may be engaged in said peripheral groove of said injector and said intermediate section of said clip aligned with said rib prior to insertion of said injector into said socket, and whereby said operating tab may be employed to rotate said clip in said grooves after insertion of said injector into said socket, said clip compressing during such rotation to permit said locking tab to pass through one of said arcuate grooves and expanding to engage said leg sections in said arcuate grooves when said locking tab has passed entirely through said one groove, said operating tab thereafter engaging said rib to exhibit further rotation of said clip and said locking tab thereafter engaging said rib to inhibit counter rotation of said clip, whereby said clip is retained in said grooves to retain said injector in said socket.

2. a fuel rail assembly as set forth in claim 1 wherein said clip further includes a second operating tab at the free end of said one leg section which may be employed to counter rotate said clip in said grooves, said clip compressing during such counter rotation to permit said locking tab to pass through said one arcuate groove, whereby said leg sections may be disengaged from said arcuate grooves and said intermediate section may be aligned with said rib to withdraw said injector from said socket.

3. A clip for retaining an injector in a socket of a fuel rail body, said body having a transversely projecting rib and said socket opening transversely through said rib, the diameter of said socket exceeding the width of said rib, said rib having arcuate grooves concentric with and opening into opposite sides of said socket, said injector having a peripheral groove, said clip having an arcuate configuration with an inside diameter exceeding the diameter of said peripheral groove and less than the diameter of said injector adjacent said peripheral groove, said arcuate configuration defining a pair of leg sections with an external diameter exceeding the diameter of said socket, said arcuate configuration further defining an intermediate section connecting said leg sections and having an external radius less than the radius of said socket, said clip further including a locking tab at the intersection of one of said leg sections and said intermediate section and an operating tab at the intersection of the other of said leg sections and said intermediate section, said tabs projecting to a radius exceeding the radius of said arcuate grooves, whereby said clip may be engaged in said peripheral groove of said injector and said intermediate section of said clip aligned with said rib prior to insertion of said injector into said socket, and whereby said operating tab may be employed to rotate said clip in said grooves after insertion of said injector into said socket, said clip compressing during such rotation to permit said locking tab to pass through one of said arcuate grooves and expanding to engage said leg sections in said arcuate grooves when said locking tab has passed entirely through said one groove, said operating tab thereafter engaging said rib to inhibit further rotation of said clip and said locking tab thereafter engaging said rib to inhibit counter rotation of said clip, whereby said clip may be retained in said grooves to retain said injector in said socket.

4. A clip as set forth in claim 3 which further includes a second operating tab at the free end of said one leg section which may be employed to counter rotate said clip in said grooves, said clip compressing during such counter rotation to permit said locking tab to pass through said one arcuate groove, whereby said leg sections may be disengaged from said arcuate grooves and said intermediate section may be aligned with said rib to withdraw said injector from said socket.

* * * * *

UNITED STATES PATENT AND TRADEMARK OFFICE

CERTIFICATE OF CORRECTION

PATENT NO. : 4475516

DATED : October 9, 1984

INVENTOR(S) : Terrance J. Atkins, Martin J. Field and Andrew J. Makusij

It is certified that error appears in the above-identified patent and that said Letters Patent are hereby corrected as shown below:

Column 3, line 39, "peripherl" should read -- peripheral --.

Column 4, line 2, "exhibit" should read -- inhibit --.

Signed and Sealed this

Sixth Day of August 1985

[SEAL]

*Attest:*

DONALD J. QUIGG

*Attesting Officer*

*Acting Commissioner of Patents and Trademarks*